US007168662B1

(12) United States Patent
McQuistian et al.

(10) Patent No.: US 7,168,662 B1
(45) Date of Patent: Jan. 30, 2007

(54) HOLLOW TIE RAILROAD SWITCHING ASSEMBLY

(75) Inventors: Kevin McQuistian, Export, PA (US); Edward E. Edwards, Jr., Export, PA (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 204 days.

(21) Appl. No.: 10/614,755

(22) Filed: Jul. 7, 2003

(51) Int. Cl.
*E01B 7/00* (2006.01)

(52) U.S. Cl. ..... 246/449; 246/162; 246/220; 246/401; 246/448; 246/450; 246/452; 246/476

(58) Field of Classification Search ..... 246/452, 246/449, 435 R, 415 R, 448, 450, 453, 454, 246/162, 220, 253, 257, 258, 259, 260, 393, 246/401, 451, 476
See application file for complete search history.

(56) References Cited

U.S. PATENT DOCUMENTS

| | | | | |
|---|---|---|---|---|
| 2,115,902 | A * | 5/1938 | Bone | 246/284 |
| 2,213,500 | A * | 9/1940 | Mock | 246/452 |
| 2,497,502 | A * | 2/1950 | Huber | 246/450 |
| 4,637,579 | A * | 1/1987 | Hartung | 246/452 |
| 5,562,267 | A * | 10/1996 | Heim et al. | 246/415 R |
| 5,620,156 | A * | 4/1997 | Berggren et al. | 246/221 |
| 6,158,698 | A | 12/2000 | Click et al. | |
| 6,290,189 | B1 * | 9/2001 | Heim | 246/449 |
| 6,543,727 | B1 * | 4/2003 | Click et al. | 246/452 |
| 6,648,276 | B1 * | 11/2003 | McQuistian | 246/452 |
| 2002/0060273 | A1 * | 5/2002 | Schwiede | 246/452 |

* cited by examiner

*Primary Examiner*—Mark T. Le
(74) *Attorney, Agent, or Firm*—David C. Jenkins; Eckert Seamans Cherin & Mellott, LLC

(57) ABSTRACT

A switching assembly includes a pair of hollow ties, a pair of supports, and a linkage. The linkage extends generally through the hollow ties, whereby the cribs are generally free of linkage components, and the ballast in the cribs can be compacted with known automated machinery. The linkage includes a number of lugs and a number of rods, with the rods each being formed from standard bar stock and threaded, and with the linkage configuration avoiding the need to custom bend any of the rods. The hollow ties are formed from generally available standard box section steel, as are the supports. The spacing between the hollow ties can be varied in accordance with the pitch of the other rail ties of the railroad switch. Each hollow tie can include a heater. The switching assembly is highly adjustable, which makes it suitable for use in numerous different track configurations.

18 Claims, 4 Drawing Sheets

HOLLOW TIE RAILROAD SWITCHING ASSEMBLY

BACKGROUND OF THE INVENTION

1. Field of the Invention

The present invention relates generally to railroad track switches and, more particularly, to a switching assembly including a linkage that extends at least partially through a pair of hollow ties.

2. Description of the Related Art

Railroad switching systems are generally understood by person skilled in the art. A typical railroad switch would include a plurality of rail ties upon which are mounted a pair of stationary stock rails, a pair of movable rails, and a switch machine. The typical switch also includes some type of linkage system operatively extending between the switch machine and the movable rails. The rail ties are disposed upon a bed of ballast, such as loose stone, which must be compacted periodically to maintain support of the railroad switch. Automated equipment is available to perform such compaction.

Each movable rail terminates at a sharpened point. The points are positioned directly above a rail tie to provide support for the points since the points are at the leading edges of the movable rails and are directly engaged by the wheels of railroad trains. At least a portion of the linkage apparatus must be connected directly with a track point for known reasons. Since known conventional rail ties are of a solid configuration, portions of the linkage that are connected with the track points must be custom bent to extend from the track point, to bend around the exterior of the rail tie, and to extend through the spaces between the rail ties into operative engagement with the switch machine. The spaces between the rail ties are referred to as "cribs".

Such complex-bent linkage components are expensive to manufacture. Additionally, the ballast in the cribs through which the linkage components extend must be packed by hand during a packing operation to avoid damaging the linkage components. Moreover, since the accumulation of ice and the like within the ballast can cause the ballast material to freeze, linkage components extending through the ballast can become difficult to move under freezing conditions.

It is thus desired to provide an improved switching assembly of a railroad switch that is relatively simpler and less expensive to manufacture, that does not require expensive maintenance such as hand packing of ballast, and that is resistant to the effects of freezing. The switching assembly preferably would be capable of use in conjunction with numerous different track configurations, and thus be highly adjustable.

SUMMARY OF THE INVENTION

An improved switching assembly of a railroad switch meets these and other needs. An improved switching assembly in accordance with the present invention includes a pair of hollow ties, a pair of supports, and a linkage. The linkage advantageously extends generally through the hollow ties, whereby the cribs between adjacent hollow and/or rail ties are generally free of linkage components, and the ballast in the cribs can be compacted with known automated machinery. The linkage includes a number of lugs and a number of rods, with the rods each being formed from standard bar stock and threaded, with the linkage configuration avoiding the need to custom bend any of the rods. The hollow ties are formed from generally available standard box section steel, as are the supports. Each hollow tie, including its support, is separate from the other hollow tie with its associated support, whereby the spacing between the hollow ties can be varied in accordance with the pitch of the other rail ties of the railroad switch. Each hollow tie can include a heater within the interior thereof to overcome the effects of freezing. The switching assembly advantageously is highly adjustable, which makes it suitable for use in numerous different track configurations.

Accordingly, an aspect of the present invention is to provide an improved switching assembly and resulting railroad switch providing cribs upon which automated compaction, i.e., tamping, can be performed.

Another aspect of the present invention is to provide an improved switching assembly and resulting railroad switch, the function of which is not resisted by ballast or freezing conditions.

Another aspect of the present invention is to provide an improved switching assembly having a great degree of adjustability and variability to permit it to be employed in conjunction with numerous different types of railroad switches.

Another aspect of the present invention is to provide an improved switching assembly that is sufficiently adjustable that the various rods thereof can be formed out of generally available bar stock without the need for forming bends in such bar stock.

Another aspect of the present invention is to provide an improved switching assembly having a pair of hollow ties and a linkage, with substantial portions of the linkage extending through the hollow ties.

Another aspect of the present invention is to provide an improved switching assembly having a linkage and a pair of hollow ties, with the hollow ties each including a first portion and a second portion that can be installed independently should the need arise, such as in tunnels and the like where limited clearance is available.

Another aspect of the present invention is to provide an improved switching assembly having a pair of hollow ties that are positionable independently of one another in order to replicate the pitch of the other rail ties of the railway.

Another aspect of the present invention is to provide an improved switching assembly that can be retrofitted into numerous different types of existing railroad switches.

Accordingly, an aspect of the present invention is to provide an improved linkage that is structured to operatively extend between a railroad switch machine and a pair of movable rails of a railroad switch, in which the general nature of the linkage can be stated as including a pair of first rail lugs, a pair of second rail lugs, an operating spread rod, an operating lug, an operating connecting rod, a lock spread rod, a lock lug, a lock connecting rod, a point detector lug, and a point detector connecting rod. One of the first rail lugs and one of the second rail lugs are structured to be operatively connected with one of the movable rails, and the other of the first rail lugs and the other of the second rail lugs are structured to be operatively connected with the other of the movable rails. The operating spread rod adjustably extends between the first rail lugs. The operating lug is structured to be connected with an operating rod of the railroad switch machine. The operating connecting rod adjustably extends between the one of the first rail lugs and the operating lug. The lock spread rod adjustably extends between the second rail lugs. The lock lug is structured to be connected with a lock rod of the railroad switch machine. The lock connecting rod adjustably extends between the one of the second rail lugs and the lock lug. The point detector lug is structured to be connected with a point detector rod of the railroad switch machine. The point detector connecting rod adjustably extends between the one of the second rail lugs and the point detector lug. The operating spread rod, the operating connecting rod, the lock spread rod, the lock connecting rod, and the point detector connecting rod are each substantially straight and at least partially threaded.

Another aspect of the present invention is to provide an improved switching assembly that is structured to be a part of a railroad switch having a switch machine, a pair of stock rails, a pair of movable rails, and a plurality of rail ties, with the switch machine including a frame, an operating rod, a lock rod, and a point detector rod, with the stock rails and the movable rails being disposed on the rail ties, and with the rail ties generally being spaced from one another at a given pitch, in which the general nature of the switching assembly can be stated as including a first hollow tie, a first support, a second hollow tie, a second support, and a linkage. The first support is mounted to the first hollow tie, and the second support is mounted to the second hollow tie. The first and second hollow ties are positionable at the given pitch with respect to one another and are structured to be positionable at the given pitch with respect to the rail ties. The first and second hollow ties are structured to have the pair of stock rails disposed thereon. The first and second supports are structured to have the switch machine mounted thereon. The linkage is structured to operatively extend between the railroad switch machine and the pair of movable rails of the railroad switch. The linkage includes a pair of first rail lugs, a pair of second rail lugs, an operating spread rod, an operating lug, an operating connecting rod, a lock spread rod, a lock lug, a lock connecting rod, a point detector lug, and a point detector connecting rod. One of the first rail lugs and one of the second rail lugs are structured to be operatively connected with one of the movable rails, and the other of the first rail lugs and the other of the second rail lugs are structured to be operatively connected with the other of the movable rails. The operating spread rod adjustably extends between the first rail lugs. The operating lug is structured to be connected with the operating rod of the railroad switch machine. The operating connecting rod adjustably extends between the one of the first rail lugs and the operating lug. The lock spread rod adjustably extends between the second rail lugs. The lock lug is structured to be connected with the lock rod of the railroad switch machine. The lock connecting rod adjustably extends between the one of the second rail lugs and the lock lug. The point detector lug is structured to be connected with the point detector rod of the railroad switch machine. The point detector connecting rod adjustably extends between the one of the second rail lugs and the point detector lug. The operating connecting rod and the operating lock rod extend generally through the first hollow tie. The lock spread rod, the lock connecting rod, and the point detector connecting rod extend generally through the second hollow tie. The operating spread rod, the operating connecting rod, the lock spread rod, the lock connecting rod, and the point detector connecting rod are each substantially straight and at least partially threaded.

BRIEF DESCRIPTION OF THE DRAWINGS

A further understanding of the invention can be gained from the following Description of the Preferred Embodiment when read in conjunction with the accompanying drawings in which.

Similar numerals refer to similar parts throughout the specification.

DESCRIPTION OF THE PREFERRED EMBODIMENT

Figure 1:
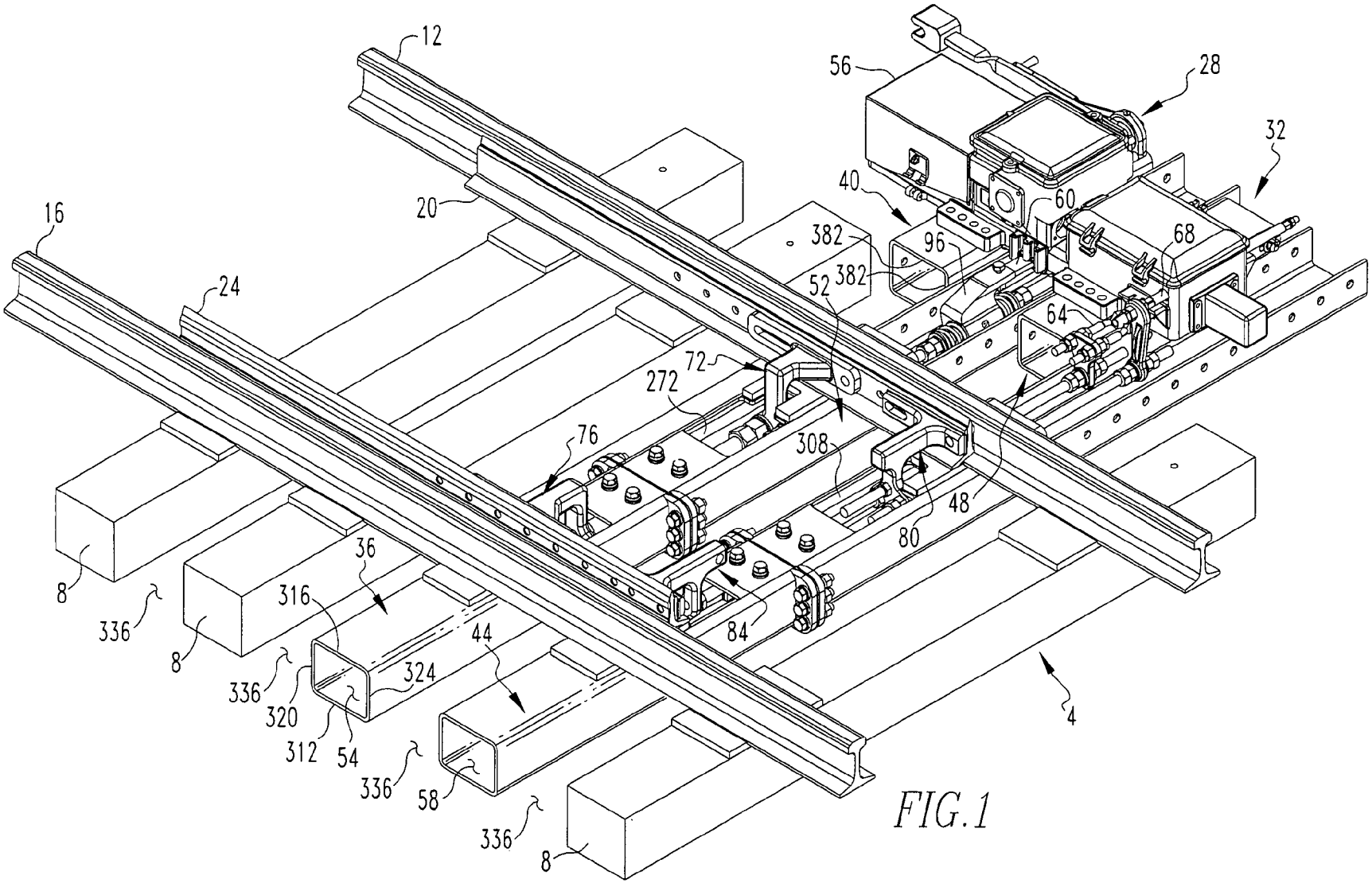
FIG. 1 is a perspective view of an improved railroad switch that incorporates an improved switching assembly in accordance with the present invention.
Figure 2:
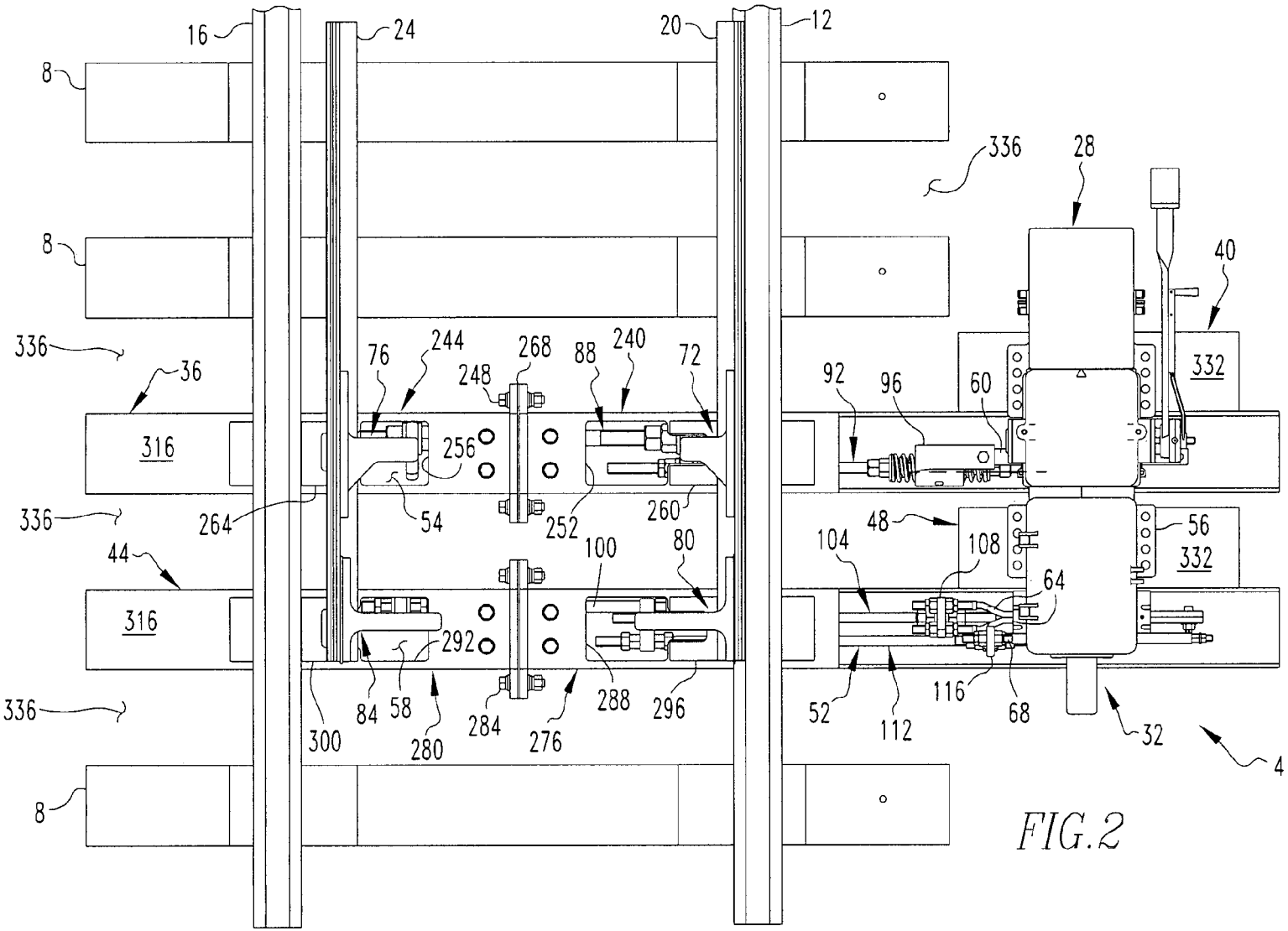
FIG. 2 is a top plan view of the railroad switch of FIG. 1.

An improved railroad switch 4 is depicted generally in FIGS. 1 and 2. The improved railroad switch 4 includes an improved switching assembly 32 in accordance with the present invention, as will be discussed below. Other than including the improved switching assembly 32 of the present invention, the railroad switch 4 is generally of a conventional configuration and includes a plurality of rail ties 8, a first stock rail 12, a second stock rail 16, a first movable rail 20, a second movable rail 24, and a switch machine 28. The first and second movable rails 20 and 24 are movable between a first position in which the first movable rail 20 is engaged with the first stock rail 12, such as is depicted generally in FIG. 1, and a second position in which the second movable rail 24 is engaged with the second stock rail 16 (not expressly depicted herein). As is understood in the relevant art, the second movable rail 24 is disengaged from the second stock rail 16 in the first position, and the first movable rail 20 is disengaged from the first stock rail 12 in the second position. As will be described in greater detail below, the switching assembly 32 operatively extends between the first and second movable rails 20 and 24 and the switch machine 28.

The switching assembly 32 includes a first hollow tie 36, a first support 40, a second hollow tie 44, a second support 48, and a linkage 52. The first support 40 is attached to the first hollow tie 36, and the second support 48 is attached to the second hollow tie 44. The attached first hollow tie and support 36 and 40 are movable independently of the attached second hollow tie and support 44 and 48, which advantageously permits the first and second hollow ties 36 and 44 to be spaced from one another at the same pitch as the spacing of the rail ties 8. The switch machine 28 is mounted to the first and second supports 40 and 48, and is positioned thereon as needed to provide proper alignment with the linkage 52, as will be described in further detail below.

The first hollow tie 36 includes an interior 54, and the second hollow tie 44 includes an interior 58. The linkage 52 can be said to extend generally through the interiors 54 and 58 of the first and second hollow ties 36 and 44, although it is noted that certain components of the linkage 52 extend outward from the interiors 54 and 58 to the exterior of the first and second hollow ties 36 and 44.

The switch machine 28 includes a frame 56, an operating rod 60, a pair of lock rods 64, and a point detector rod 68. The operating, lock, and point detector rods 60, 64, and 68 are disposed on the frame 56 and function in a known fashion.

Figure 3:
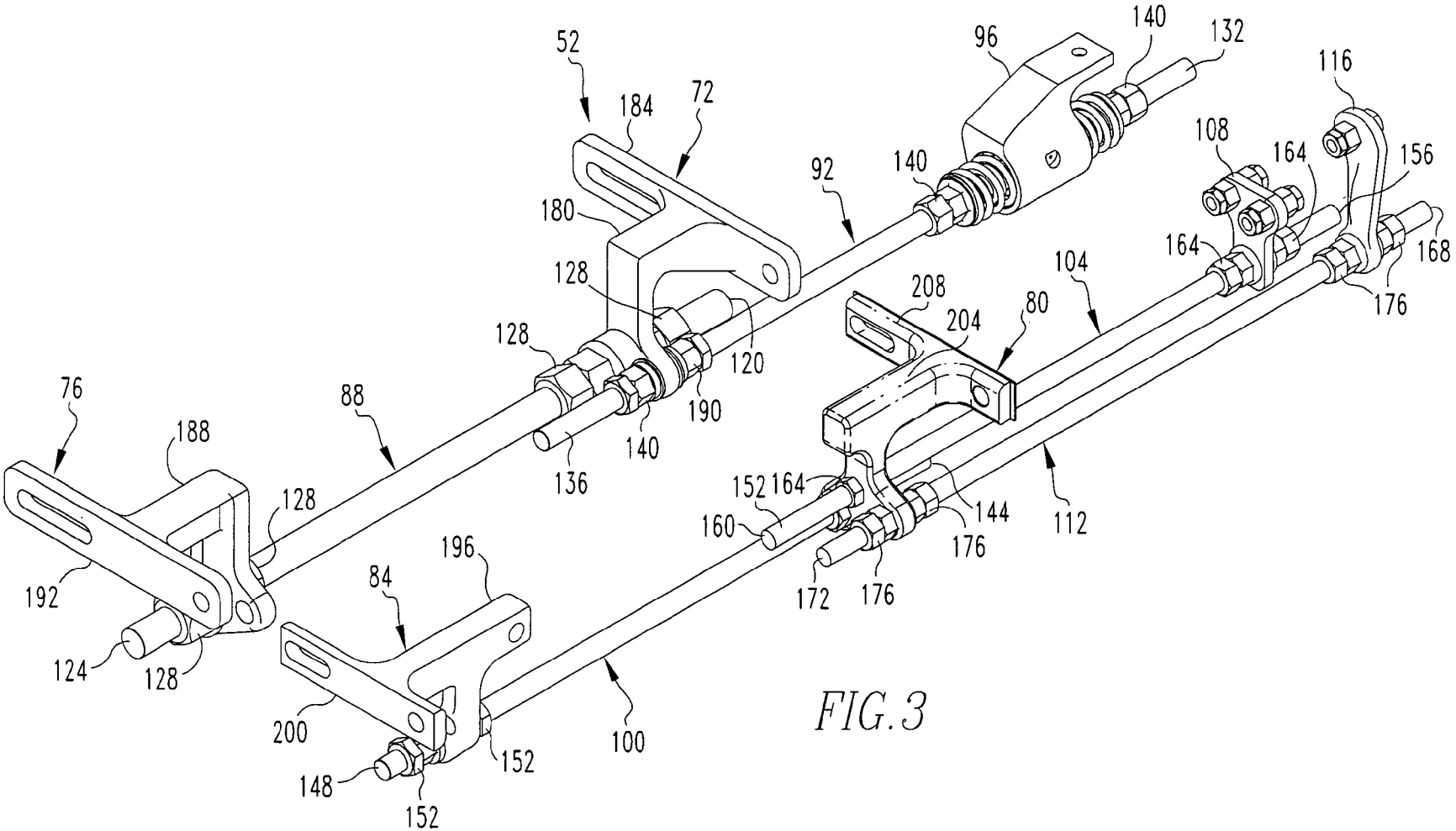
FIG. 3 is a perspective view of a linkage of the switching assembly of FIG. 1.

As can be understood from FIGS. 1–3, the linkage 52 includes a pair of first rail lugs 72 and 76, a pair of second rail lugs 80 and 84, an operating spread rod 88, an operating connecting rod 92, an operating lug 96, a lock spread rod 100, a lock connecting rod 104, a lock lug 108, a point detector connecting rod 112, and a point detector lug 116.

The first rail lugs 72 and 76 are mirror images of one another, and the second rail lugs 80 and 84 are likewise mirror images of one another. This promotes versatility by permitted the linkage 52 to be configured as a mirror image of FIG. 3.

As is best shown in FIGS. 1 and 2, the first and second rail lugs 72 and 80 are affixed to the first movable rail 20 with appropriate fasteners (not shown for purposes of clarity) such as bolts and the like. The first and second rail lugs 76 and 84 are affixed to the second movable rail 24 with similar fasteners (again not shown for purposes of clarity). The second rail lugs 80 and 84 are connected with the first and second movable rails 20 and 24, respectively, at the points thereof.

The operating spread rod 88 adjustably extends between the first rail lugs 72 and 76. The operating connecting rod 92 adjustably extends between the first rail lug 72 and the operating lug 96. As can be understood from FIG. 2, the operating lug 96 is connected with the operating rod 60 of the switch machine 28. The operating lug 96 is a lost motion device including springs and is configured to convert the fixed travel of the operating rod 60 into an appropriate distance of travel for the first and second movable rails 20 and 24 between the aforementioned first and second positions. The operating rod 60 of the switch machine 28 provides the energy to shift the first and second movable rails 20 and 24 between the first and second positions, and the operating spread and connecting rods 88 and 92 transfer such energy to the first and second movable rails 20 and 24. The operating spread and connecting rods 88 and 92 generally extend through the interior 54 of the first hollow tie 36.

The lock spread rod 100 adjustably extends between the second rail lugs 80 and 84. The lock connecting rod 104 adjustably extends between the second rail lug 80 and the lock lug 108. As can be understood from FIGS. 1 and 2, the lock lug 108 is mounted to the lock rods 64 of the switch machine 28. As is understood in the relevant art, the switch machine 28 locks the lock rods 64 in a given position that corresponds with the first position or the second position of the first and second movable rails 20 and 24. The lock spread and connecting rods 100 and 104 transfer the locking function from the lock rod 64 to the first and second movable rails 20 and 24.

The point detector connecting rod 112 adjustably extends between the second rail lug 80 and the point detector lug 1116. As can be understood from FIGS. 1 and 2, the point detector lug 116 is mounted to the point detector rod 68 of the switch machine 28. In a known fashion, the point detector rod 68 indicates to the switch machine 28 the position of the point of the first movable rail 20, and the point detector connecting rod 112 transfers such condition to the point detector rod 68. The lock spread and connecting rods 100 and 104 and the point detector connecting rod 112 generally extend through the interior 58 of the second hollow tie 44.

As can be understood from FIG. 2, the switch machine 28 is positioned on the first and second supports 40 and 48 such that the operating, lock, and point detector rods 60, 64, and 68 of the switch machine are generally aligned with the operating, lock, and point detector lugs 96, 108, and 1116, respectively, of the linkage 52. In this regard, the switch machine 28 is positioned on the first and second supports 40 and 48 in order to achieve such alignment, and the switch machine 28 is then attached to the first and second supports 40 and 48.

Such adjustability and alignability permit the operating spread and connecting rods 88 and 92, the lock spread and connecting rods 100 and 104, and the point detector connecting rod 112 to be formed from straight standard bar stock that is cut to length and is at least partially threaded. The operating spread and connecting rods 88 and 92, the lock spread and connecting rods 100 and 104, and the point detector connecting rod 112 are substantially straight, and thus substantially free of bends. Such straightness obviates the need for custom bending of such members, which reduces the cost thereof and correspondingly increases the versatility thereof.

The operating spread rod 88 has a first threaded end 120, a second threaded end 124, and a plurality of nuts 128 that are threadably cooperable therewith. The first threaded end 120 is mounted to the first rail lug 72 with a plurality of the nuts 128. The threadability of the nuts 128 on the first threaded end 120 permits the first threaded end 120 to be adjustable with respect to the first rail lug 72 prior to final tightening of the nuts 128. Specifically, two pairs of the nuts 128 connect the first threaded end 120 with the first rail lug 72. The nuts 128 are provided in pairs so that one nut 128 of each pair serves as a jam nut for the other nut 128 of the pair, and this configuration is common to the other rods of the linkage 52. The second threaded end 124 is similarly mounted with a plurality of the nuts 128 to the first rail lug 76 and is adjustable with respect thereto prior to final tightening of the corresponding nuts 128.

The operating connecting rod 92 includes a first threaded end 132, a second threaded end 136, and a plurality of nuts 140 that are threadably cooperable therewith. The first threaded end 132 is adjustably mounted to the operating lug 96, and the second threaded end 136 is similarly adjustably mounted with a plurality of the nuts 140 to the first rail lug 72.

The lock spread rod 100 similarly includes a first threaded end 144, a second threaded end 148, and a plurality of nuts 152 that are threadably cooperable therewith. The lock spread rod 100 extends between and is adjustably mounted to each of the second rail lugs 80 and 84 prior to final tightening of the nuts 152 on the first and second threaded ends 144 and 148, respectively.

The lock connecting rod 104 includes a first threaded end 156, a second threaded end 160, and a plurality of nuts 164 that are threadably cooperable therewith. The first threaded end 156 is adjustably mounted to the lock lug 108, and the second threaded end 160 is adjustably mounted to the second rail lug 80, with the first and second threaded ends 156 and 160 each being adjustable prior to final tightening of the nuts 164.

The point detector connecting rod 112 includes a first threaded end 168, a second threaded end 172, and a plurality of nuts 176 that are threadably cooperable therewith. The first threaded end 168 is adjustably mounted to the point detector lug 116, and the second threaded end 172 is adjustably mounted to the second rail lug 80, with the first and second threaded ends 168 and 172 each being adjustable prior to final tightening of the nuts 176.

It thus can be seen that the spread, i.e., the spacing, between the first rail lugs 72 and 76, and thus between the first and second movable rails 20 and 24, can be adjusted by the operating spread rod 88 independently of any adjustment of the operating connecting rod 92. In the depicted exemplary embodiment, this is because the operating spread rod 88 and the operating connecting rod 92 extend through and are mounted to different, i.e., separate, holes formed on the first rail lug 72.

Similarly, the spread between the second rail lugs 80 and 84, and thus between the first and second movable rails 20 and 24, is adjustable independently of any adjustment of the lock connecting rod 104 and/or the point detector connecting rod 112. In the exemplary depicted embodiment, this is because the lock spread rod 100, the lock connecting rod 104, and the point detector connecting rod 112 extend through and are mounted to separate holes on the second rail lug 80.

The first rail lug 72 includes a body 180 and a plate 184. The operating spread and connecting rods 88 and 92 extend through and are attached to separate holes formed in the body 180. The plate 184 is affixed to the first movable rail 20. The elongated slot formed in the plate 184 contributes to the versatility in positioning the first rail lug 72 on the first movable rail 20.

The first rail lug 76 similarly includes a body 188 and a plate 192. The operating spread rod 88 is mounted to the body 188, and the plate 192 is attached to the second movable rail 24.

The second rail lug 84 likewise includes a body 196 and a plate 200. The lock spread rod 100 is attached to the body 196, and the plate 200 is attached to the second movable rail 24.

The second rail lug 80 includes a body 204 and a plate 208. The plate 208 is attached to the first movable rail 20. As is best shown in FIG. 4, the body 204 includes a first mounting hole 220, a second mounting hole 224, and a third mounting hole 236 formed therein.

Figure 4:
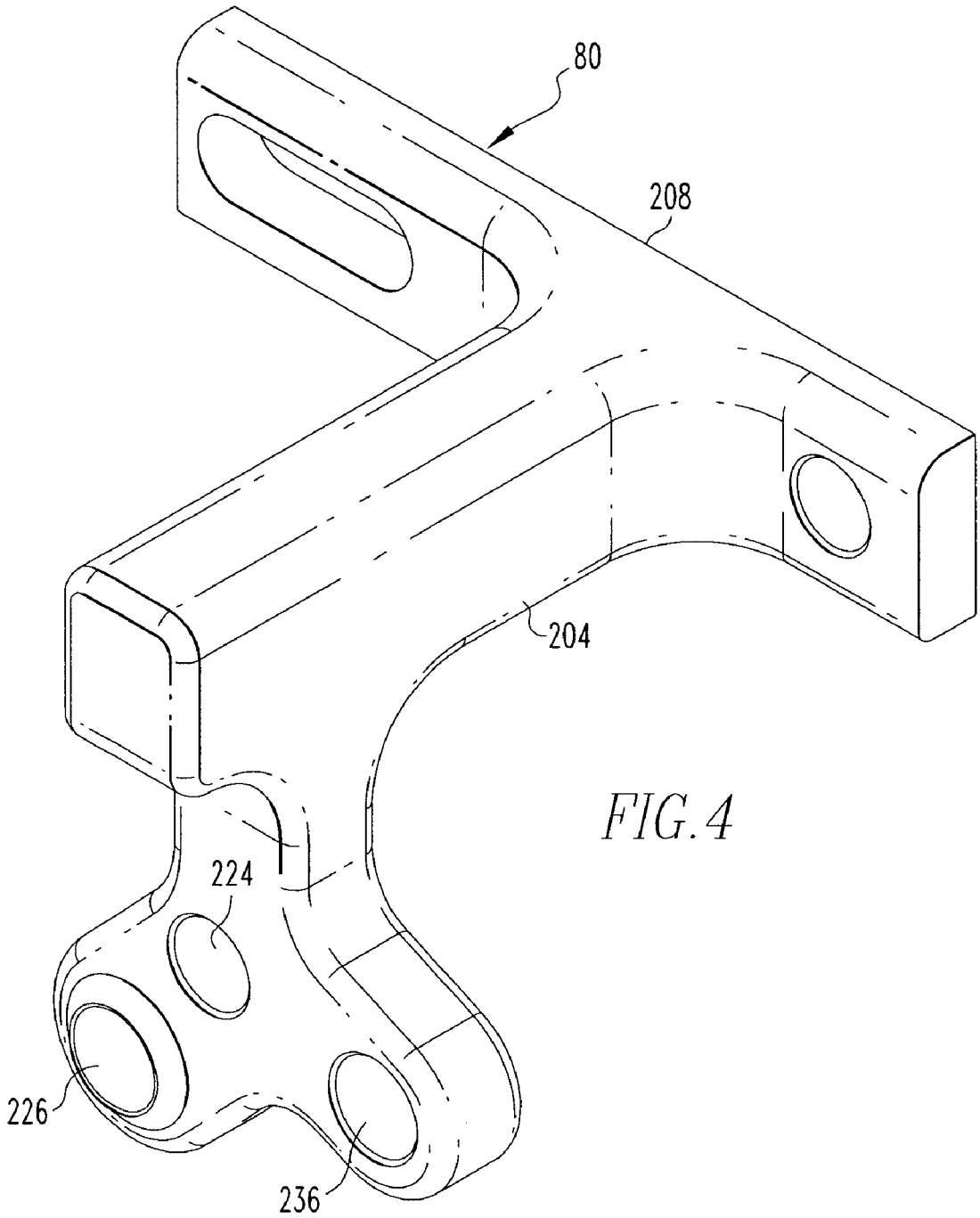
FIG. 4. is a perspective view of a portion of the linkage of FIG. 3.

As can be understood from FIGS. 3 and 4, the lock spread rod 100 extends through the first mounting hole 220 and is mounted thereto with the nuts 152. The lock connecting rod 104 extends through the second mounting hole 224 and is mounted thereto with the nuts 164. The point detector connecting rod 112 extends through the third mounting hole 236 and is mounted thereto with the nuts 176. It thus can be understood that the lock spread rod 100, the lock connecting rod 104, and the point detector connecting rod 112 are each mounted to separate holes on the second rail lug 80, and each is independently adjustable thereon prior to the final tightening of the respective nuts thereof.

The configuration of the second rail lug 80 thus provides an indication of the adjustability of the various components of the linkage 52 with respect to one another, and also indicates the versatility of the switching assembly 32 for use in association with numerous different railroad switches. As set forth above, the adjustability of the positioning of the switch machine 28 on the first and second supports 40 and 48 permits an advantageous alignment whereby the various rods of the linkage 52 can be formed out of conventional straight bar stock without the need for custom bending, which is also advantageous for the reasons set forth above.

As is best shown in FIGS. 1 and 2, the first hollow tie 36 includes a first portion 240 and a second portion 244 that are connected with one another at a flanged region with a plurality of fasteners 248 which, in the exemplary embodiment, are in the form of nuts and bolts. The first portion 240 includes an access hole 252 formed therein, and the second portion 244 includes an access hole 256 formed therein. The first portion 240 includes a notched tie plate 260 upon which the first stock rail 12 and the first movable rail 20 are disposed. The second portion 244 includes a notched tie plate 264 disposed thereon, with the second stock rail 16 and the second movable rail 24 being disposed on the notched tie plate 264. It is noted that while the first and second stock rails 12 and 16 are stationarily disposed on the notched tie plates 260 and 264, respectively, the first and second movable rails 20 and 24 are movably disposed on the notched tie plates 260 and 264, respectively. The first hollow tie 36 additionally includes an insulation sheet 268 interposed between the first and second portions 240 and 244 to provide electrical insulation therebetween. The fasteners 248 similarly extend through insulating structures to provide electrical isolation between the first and second portions 240 and 244. The first hollow tie 36 additionally includes a heater 272 within the interior 54 to resist the formation of ice on or within the first hollow tie 36 and to resist freezing of the linkage 52. The heater 272 is, however, optional.

The second hollow tie 44 is substantially identical to the first hollow tie 36 and, in practice, likely will be interchangeable therewith. In this regard, therefore, the second hollow tie 44 similarly is configured to include a first portion 276 and a second portion 280 fastened together with a plurality of fasteners 284 but electrically insulated from one another by an insulation sheet 304 and by other insulating structures about the fasteners 284. The first and second portions 276 and 280 each include an access hole 288 and 292, respectively, formed therein, and likewise each include a notched tie plate 276 and 300, respectively, disposed thereon. A heater 308 is disposed within the interior 58 of the second hollow tie 44.

By configuring the first and second hollow ties 36 and 44 to be two-part members, the first portions 240 and 276 can be disposed under the first stock rail 12 and the first movable rail 20 independently of the second portions 244 and 280 being received under the second stock rail 16 and the second movable rail 24, and vice-versa. This advantageous configuration permits the first and second hollow ties 36 and 44 to be installed in applications having limited lateral room, such as within a tunnel.

As is best understood from FIG. 1, the elongated portions of the first hollow tie 36 are formed out of a length of material, such as lengths of conventional steel box section, and include a bottom web 312, a top web 316, and a pair of side webs 320 and 324. The bottom and top webs 312 and 316 each extend between both of the side webs 320 and 324. The access holes 252 and 256 are formed in the top web 316 of the first hollow tie 36. The second hollow tie 44 is similarly configured.

The first support 40 is formed of a length of material which, as in the depicted embodiment, may be of a box section and, in particular, includes a support web 328 and a mounting web 332, with the support web 328 being mounted to the side web 320, and with the mounting web 332 being attached to the support web 328. The switch machine 28 is mounted on the mounting web 332 and the corresponding mounting web of the second support 48.

While not expressly depicted herein, the switching assembly 32 may, and likely will, include covers disposed over the access holes 252, 256, 288, and 292 to resist the entry of the ballast material into the interiors 54 and 58 of the first and second hollow ties 36 and 44. Similarly, the open regions of the first portions 240 and 276 within which the operating lug 96 and the lock and point detector lugs 108 and 116, respectively, are disposed likewise may, and likely will, include appropriate covers disposed thereon that resist the entry of ballast material into the interiors 54 and 58.

It thus can be seen that the rods of the linkage 52 extend through the interiors 54 and 58 of the first and second hollow ties 36 and 44. The first and second rail lugs 72, 76, 80, and 84 extend through the access holes 252, 256, 288, and 292, meaning that they extend between the interiors 54 and 58 of the first and second hollow ties 36 and 44, respectively, to the exteriors thereof. The operating lug 96, the lock lug 108, and the point detector lug 116 similarly extend, respectively, between the interiors 54 and 58 of the first and second hollow ties 36 and 44 and the exteriors.

By configuring the switching assembly 32 such that substantial portions of the linkage 52 extend within the interiors 54 and 58 of the first and second hollow ties 36 and 44, no portions of the linkage 52 are received in any of the cribs 336 between the first and second hollow ties 36 and 44 and/or the cribs 336 adjacent the first and second hollow ties 36 and 44 and the rail ties 8. The switching assembly 32 thus permits automated compression, i.e., tamping, machines to be employed within all of the cribs 336 without the need for manual compaction or the risk of damaging any components of the linkage 52. Similarly, by disposing substantial portions of the linkage 52 within the interiors 54 and 58, movement of the linkage 52 is not impeded by the ballast, and likewise is not subject to resistance due to freezing of the ballast or of substances such as water in the ballast. In this regard, the heaters 272 and 308 are helpful.

As set forth above, the great adjustability of the switching assembly 32 as to the first and second hollow ties 36 and 44, with the associated first and second supports 40 and 48, as well as the linkage 52 permit the switching assembly 32 to be employed in conjunction with numerous different types of switches. The configuration of the first and second supports 40 and 48 advantageously enhances the alignability of the switch machine 28 with the components of the linkage 52, which further advantageously permits the operating spread and connecting rods 88 and 92, the lock spread and connecting rods 100 and 104, and the point detector connecting rod 112 to be formed of generally available bar stock that is straight and substantially free of bends and that is at least partially threaded. While the rods depicted herein are of a substantially circular cross section throughout the longitudinal extent thereof, it is noted that other cross sections can be employed in certain areas, such as polygonal or other cross sectional shapes.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A linkage structured to operatively extend between a railroad switch machine and a pair of movable rails of a railroad switch, the linkage comprising:

a pair of first rail lugs;

a pair of second rail lugs;

one of the first rail lugs and one of the second rail lugs being structured to be operatively connected with one of the movable rails, the other of the first rail lugs and the other of the second rail lugs being structured to be operatively connected with the other of the movable rails;

an operating spread rod adjustably extending between the first rail lugs;

an operating lug structured to be connected with an operating rod of the railroad switch machine;

an operating connecting rod adjustably extending between the one of the first rail lugs and the operating lug;

a lock spread rod adjustably extending between the second rail lugs;

a lock lug structured to be connected with a lock rod of the railroad switch machine;

a lock connecting rod adjustably extending between the one of the second rail lugs and the lock lug;

a point detector lug structured to be connected with a point detector rod of the railroad switch machine;

a point detector connecting rod adjustably extending between the one of the second rail lugs and the point detector lug;

the operating spread rod, the operating connecting rod, the lock spread rod, the lock connecting rod, and the point detector connecting rod each being substantially straight without any significant bent portion and at least partially threaded.

2. The linkage as set forth in claim 1, in which the operating spread rod, the operating connecting rod, the lock spread rod, the lock connecting rod, and the point detector connecting rod each include a first threaded end and a second threaded end.

3. The linkage as set forth in claim 2, in which the operating spread rod, the operating connecting rod, the lock spread rod, the lock connecting rod, and the point detector connecting rod each include a plurality of nuts, with at least one of the nuts of each of the operating spread rod, the operating connecting rod, the lock spread rod, the lock connecting rod, and the point detector connecting rod being threadably cooperable with the first threaded end thereof, and with at least another of the nuts of each of the operating spread rod, the operating connecting rod, the lock spread rod, the lock connecting rod, and the point detector connecting rod being threadably cooperable with the second threaded end thereof.

4. The linkage as set forth in claim 3, in which the one of the second rail lugs includes a first mounting hole extending therethrough and a second mounting hole extending therethrough;

the lock connecting rod being adjustably received through the first mounting hole;

the lock spread rod being adjustably received through the second mounting hole.

5. The linkage as set forth in claim 1, in which the operating spread rod and the operating connecting rod are each adjustable independently of one another with respect to the one of the first rail lugs.

6. The linkage as set forth in claim 5, in which the lock spread rod, the lock connecting rod, and the point detector connecting rod are each adjustable independently of one another with respect to the one of the second rail lugs.

7. A switching assembly structured to be a part of a railroad switch having a switch machine, a pair of stock rails, a pair of movable rails, and a plurality of rail ties, the switch machine including a frame, an operating rod, a lock rod, and a point detector rod, the stock rails and the movable rails being disposed on the rail ties, the rail ties generally being spaced from one another at a given pitch, the switching assembly comprising:

a first hollow tie;

a first support mounted to the first hollow tie;

a second hollow tie;

a second support mounted to the second hollow tie;

the first and second hollow ties being positionable at the given pitch with respect to one another and being structured to be positionable at the given pitch with respect to the rail ties;

the first and second hollow ties being structured to have the pair of stock rails disposed thereon the first and second supports being structured to have the switch machine mounted thereon;

a linkage structured to operatively extend between the railroad switch machine and the pair of movable rails of the railroad switch;

the linkage including a pair of first rail lugs, a pair of second rail lugs, an operating spread rod, an operating lug, an operating connecting rod, a lock spread rod, a lock lug, a lock connecting rod, a point detector lug, and a point detector connecting rod;

one of the first rail lugs and one of the second rail lugs being structured to be operatively connected with one of the movable rails, the other of the first rail lugs and the other of the second rail lugs being structured to be operatively connected with the other of the movable rails;

the operating spread rod adjustably extending between the first rail lugs;

the operating lug being structured to be connected with the operating rod of the railroad switch machine;

the operating connecting rod adjustably extending between the one of the first rail lugs and the operating lug;

the lock spread rod adjustably extending between the second rail lugs;

the lock lug being structured to be connected with the lock rod of the railroad switch machine;

the lock connecting rod adjustably extending between the one of the second rail lugs and the lock lug;

the point detector lug being structured to be connected with the point detector rod of the railroad switch machine;

the point detector connecting rod adjustably extending between the one of the second rail lugs and the point detector lug;

the operating connecting rod extending generally through the first hollow tie;

the lock spread rod, the lock connecting rod, and the point detector connecting rod extending generally through the second hollow tie; and the operating spread rod, the operating connecting rod, the lock spread rod, the lock connecting rod, and the point detector connecting rod each being substantially straight without any significant bent portion and at least partially threaded.

8. The switching assembly as set forth in claim 7, in which the first and second hollow ties each include a bottom web, a top web, and a pair of side webs, with the top web and the bottom web each extending between and being connected with both of the side webs.

9. The switching assembly as set forth in claim 8, in which the first and second hollow ties each include at least a first access hole formed in the top web, at least a portion of at least one of the first rail lugs extending through the at least first access hole formed in the first hollow tie, at least a portion of at least one of the second rail lugs extending through the at least first access hole formed in the second hollow tie.

10. The switching assembly as set forth in claim 8, in which the first and second hollow ties each include an interior;

the operating lug extending between the interior of the first hollow tie and the exterior thereof;

the lock lug and the point detector lug each extending between the interior of the second hollow tie and the exterior thereof.

11. The switching assembly as set forth in claim 7, in which the operating spread rod, the operating connecting rod, the lock spread rod, the lock connecting rod, and the point detector connecting rod each include a first threaded end and a second threaded end.

12. The switching assembly as set forth in claim 11, in which the operating spread rod, the operating connecting rod, the lock spread rod, the lock connecting rod, and the point detector connecting rod each include a plurality of nuts, with at least one of the nuts of each of the operating spread rod, the operating connecting rod, the lock spread rod, the lock connecting rod, and the point detector connecting rod being threadably cooperable with the first threaded end thereof, and with at least another of the nuts of each of the operating spread rod, the operating connecting rod, the lock spread rod, the lock connecting rod, and the point detector connecting rod being threadably cooperable with the second threaded end thereof.

13. The switching assembly as set forth in claim 12, in which the one of the second rail lugs includes a first mounting hole extending therethrough and a second mounting hole extending therethrough;

the lock connecting rod being adjustably received through the first mounting hole;

the lock spread rod being adjustably received through the second mounting hole.

14. The switching assembly as set forth in claim 13, in which the lock spread rod, the lock connecting rod, and the point detector connecting rod are each adjustable independently of one another with respect to the one of the second rail lugs.

15. The switching assembly as set forth in claim 14, in which the operating spread rod and the operating connecting rod are each adjustable independently of one another with respect to the one of the first rail lugs.

16. The switching assembly as set forth in claim 7, in which the first and second hollow ties each include a first portion and a second portion connected together.

17. The switching assembly as set forth in claim 16, in which the first and second portions are electrically insulated from one another.

18. The switching assembly as set forth in claim 16, in which the first and second hollow ties each include a bottom web, a top web, and a pair of side webs, the top web and the bottom web each extending between and being connected with both of the side webs;

the first and second portions of each the first and second hollow ties each including an access hole formed in the top web, the first rail lugs extending through the access holes formed in the first hollow tie, the second rail lugs extending through the access holes formed in the second hollow tie.

* * * * *

UNITED STATES PATENT AND TRADEMARK OFFICE

CERTIFICATE OF CORRECTION

PATENT NO. : 7,168,662 B1
APPLICATION NO. : 10/614755
DATED : January 30, 2007
INVENTOR(S) : Kevin McQuistian et al.

It is certified that error appears in the above-identified patent and that said Letters Patent is hereby corrected as shown below:

Column 5, lines 48 and 62, “1116” should read --116--

Signed and Sealed this

Third Day of July, 2007

JON W. DUDAS
*Director of the United States Patent and Trademark Office*